United States Patent [19]

Arnold

[11] Patent Number: 5,012,960

[45] Date of Patent: May 7, 1991

[54] GROOVE PROTECTOR AND SPOUT

[76] Inventor: Samuel C. Arnold, 2315 Fairview Dr., Alton, Ill. 62002

[21] Appl. No.: 579,816

[22] Filed: Sep. 10, 1990

Related U.S. Application Data

[63] Continuation of Ser. No. 472,024, Jan. 30, 1990, abandoned. which is a continuation-in-part of Ser. No. 332,476, Apr. 3, 1989, abandoned.

[51] Int. Cl.[5] ..... B65D 25/40

[52] U.S. Cl. ..... 222/570; 220/85 SP

[58] Field of Search ..... 222/569, 570; 220/90, 220/85 SP

[56] References Cited

U.S. PATENT DOCUMENTS

| | | | |
|---|---|---|---|
| 2,646,193 | 7/1953 | Best | 222/570 |
| 2,722,347 | 11/1955 | Henke | 222/570 |
| 2,873,881 | 2/1959 | Nichols | 220/90 |
| 3,221,955 | 12/1965 | Banaszak et al. | 222/570 |
| 3,899,107 | 8/1975 | Gaal | 222/570 |
| 3,994,424 | 11/1976 | Koeller | 222/570 |
| 4,020,968 | 5/1977 | Chiavola | 222/570 X |
| 4,034,901 | 7/1977 | Kirk | 222/570 X |
| 4,125,210 | 11/1978 | Embree | 222/570 |
| 4,203,537 | 5/1980 | McAlister | 222/570 |
| 4,225,064 | 9/1980 | Westcott | 222/570 X |
| 4,240,568 | 12/1980 | Pool | 222/570 X |
| 4,850,501 | 7/1989 | Shield | 222/569 X |

*Primary Examiner*—Kevin P. Shaver

*Attorney, Agent, or Firm*—Haverstock, Garrett and Roberts

[57] ABSTRACT

A paint can top lid groove protector and spout. The protector consists of a ring formed with a top surface and an inside wall and outside wall. The ring is engageable in a covering relationship to a paint can rim groove, formerly occupied by the can lid. The contents of the can remain exposed. The spout consists of a pair of pour guards defining an orifice for pouring. The pour guards have raised lip portions extending to the outer edge of the ring. The top surface extends slightly past the outside wall to allow the device to be pulled up and removed.

1 Claim, 1 Drawing Sheet

GROOVE PROTECTOR AND SPOUT

This is a continuation of Arnold U.S. patent application Ser. No. 472,024, filed Jan. 30, 1990, now abandoned, which is a continuation in part of U.S. patent application Ser. No. 332,476, filed Apr. 3, 1989, now abandoned.

BACKGROUND OF THE INVENTION

The present invention relates to painting accessories and more particularly to accessories for paint cans having means for preventing the accumulation of paint in the groove of a paint can and having means for guiding the flow of paint from a paint can when pouring. Painting an object with a paint brush out of an open paint can often results in the lid groove portion of the paint can filling up with paint. This may result when one removes excess paint from the paint brush by wiping it off against the top inside edge of the can or when paint is poured from the can. When the painting job is complete and there is paint to be saved, one must first clean out the groove before the lid is replaced, or else the paint in the groove will splatter when the lid is tapped in place. Cleaning the groove can be time consuming and frustrating and if one fails to remove all the paint, the result can be a less than airtight seal and the remaining paint may dry out during storage. Another problem that can result from not being able to remove all the paint from the can lid groove is that the lid may adhere to the remaining paint in the groove, causing reopening of the can lid at a future date to be more difficult. Pouring paint from a paint can in to another container is not easy to control which makes it difficult to pour into containers having relatively small openings. Paint generally enters the groove area during pouring causing the problem stated above and usually also flows over the side of the can causing a mess.

A variety of devices exist in the prior art which are designed to address the problems outlined above. The existing devices are generally constructed of plastic-type material having a ring portion engageable in a covering relation with a paint can rim, secured thereon by a compression or friction fit. The devices also generally have a pouring spout portion which extends outwardly in a radial direction from one edge of the ring portion for guiding the flow of paint when pouring and providing a platform on which to rest a brush when not in use. This outwardly extending pouring spout portion, while providing a means for guiding paint poured from the can and a surface on which to rest a paint brush when not in use, is obtrusive. Often painters accidentally brush against or catch the outwardly projecting spout portion with their trouser leg or kick the spout causing the paint can to tip and the paint contained therein to spill. The outwardly extending spout portion also prevents the closely spaced positioning of several paint cans in a close space as for instance would be desirable when painting with several cans of paint while standing on a ladder or similar place where the available area to store the the paint cans is limited.

SUMMARY OF THE INVENTION

The present invention is directed to overcome the above outlined limitations and shortcomings of the existing devices. The present invention teaches a groove protector and spout device which is attachable to the rim portion of a paint can and which is held in place thereon by friction or compression. The present invention comprises a ring portion defining a circular opening and having a substantially planar surface portion with outwardly extending inner and outer concentric annular wall portions extending outwardly from one side thereof. The outer wall portion is located just inside the outer periphery of the planar ring portion so as to leave a lip therearound for grasping with one's fingertips to remove the device from a paint can. The inner wall portion is located immediately adjacent the inside edge of the ring portion. Also extending outwardly from the planar ring portion is an annular ridge portion or insert located intermediately between the inner and outer walls which is engageable with the groove portion of a paint can. Circumferentially spaced around the inner edge of the planar ring portion are a pair of pour guard members which extend into the opening defined by the ring portion. The pour guard portions are positioned so as to close spaced portions of the opening in the ring leaving a relatively narrow opening, one end of which is bordered by the inside edge of the ring portion, the other end of which is open to the remaining uncovered portion of the opening. Positioned on the inside edge of each of the pour guard members is an upwardly extending curved piece or lip which extends along the length of the pour guard member across the surface of the ring member to the outer edge thereof so as to define a spout portion. As above described, the present invention provides a means for protecting the rim of a paint can and means for guiding the flow of paint poured from a can which is easily placeable on and removeable from a paint can, but the spout means does not extend outwardly from the groove protector portion.

It is therefore an object of the present invention to keep the lid groove area of a paint can clean.

Another object is to make it easier to pour the paint from a can.

Another object is to save time, by not having to clean out the groove before replacing the lid.

Another object is to provide a cleaner seal to help protect any remaining paint, and enhance the lid removal at a later date.

Another object is to provide a groove protector and spout combination wherein the spout does not project substantially beyond the periphery of the can when the device is in place on a paint can.

These and other objects and advantages of the present invention will become apparent to those skilled in the art after considering the following detailed specification in conjunction with the accompanying drawings wherein:

DETAILED DESCRIPTION OF THE PREFERRED EMBODIMENT

Figure 1:
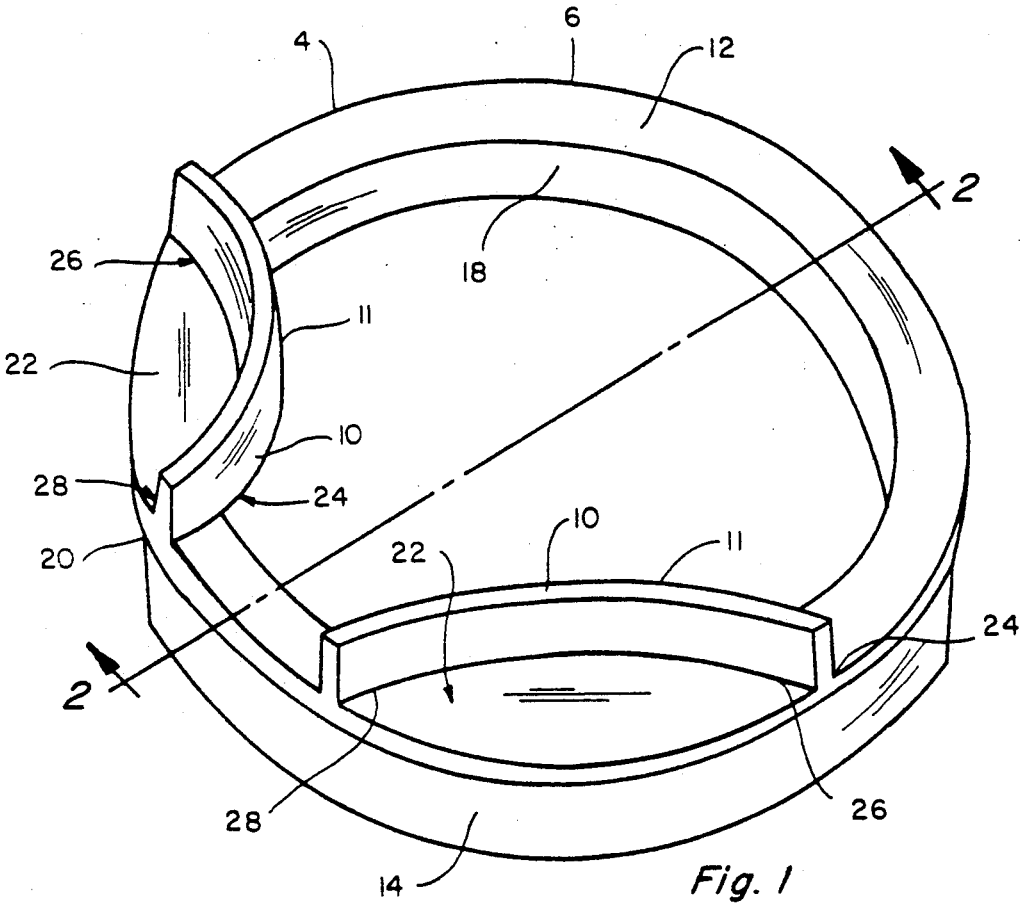
FIG. 1 is a perspective drawing of the present lid groove protector and pouring spout.
Figure 2:
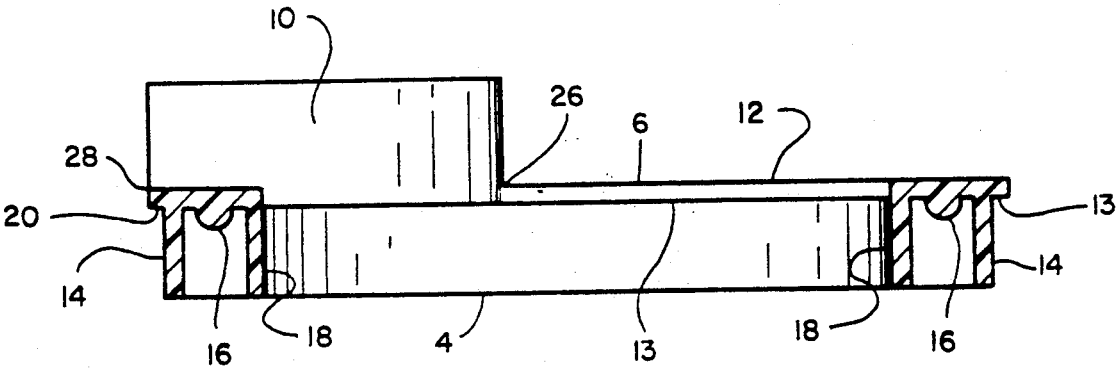
FIG. 2 is a sectional side elevational view of the present protector and spout taken along line 2—2, showing the planar ring portion, the inside and outside walls and the insert portion in cross-section.

Referring to the drawings more particularly by reference numbers, wherein like numerals refer to like parts, number 4 in FIG. 1 identifies a groove protector and spout device constructed according to the teachings of the present invention. The groove protector and spout device 4 is constructed of a plastic material and generally includes a protector ring 6 and a pair of lips or curved pieces 10 which form a spout 11. The protector ring 6 includes a substantially planar, annular top surface 12 having a substantially round opening and a bottom side 13. Extending downwardly from the bottom side 13 is an outside wall 14, an insert 16 and an inside wall 18. The outside wall 14 extends around the bottom side 13 and is located near the outer edge thereof, but is sufficiently spaced therefrom to leave a narrow lip 20 around the outside of outer wall 14. Lip 20 is sufficiently wide to be easily grasped with the fingertips for pulling up and removing the device 4 from a paint can, but is not so wide as to project outwardly in a protruding manner. Additionally, while in the preferred embodiment the lip 20 is continuous, extending completely around the circumference of bottom side 13, it is foreseen that the lip 20 could be discontinuous or extend only around a portion of the circumference with equal utility. The inside wall 18 also extends around the circumference of bottom side 13 but is located adjacent the inside edge thereof so as to be parallel with and spaced from the outside wall 14. Intermediately spaced between the outside wall and inside walls, 14 and 18 respectively, is the insert 16 which comprises an outwardly extending annular raised portion or ridge, extending around the bottom side 13. The groove protector 4 is formed to fit over the top of an open paint can.

In use, the protector ring 6 portion of the device 4 is pressed in place over the top of an open paint can, with the bottom side 13 contacting the top of the can and the insert 16 occupying the groove formerly engaged by the can lid. The inside wall 18 and outside wall 14 along with the top surface 12 form the protective cover for the lid groove area. The lip 20 extending slightly past the outside wall 14 allows the device to be pulled up and removed. The two curved pieces 10 protrude above the top surface 12 to create a spout 11 to guide the paint flowing from the can when the can is tipped to pour.

Describing the spout 11 in more detail, the spout 11 generally includes two opposed pour guards 22 coplanarly joined to the top surface 12 with the curved pieces 10 extending therefrom. The opposed pour guards 22 are spacedly related, extending inwardly from the innermost edge of surface 12, respectively closing spaced portions of the opening defined by the surface 12. Each pour guard 22 has a inner edge 24 which in the preferred embodiment is convex-shaped having a first end 26 and second end 28, the first ends 26 being adjacent the surface 12 and relatively more remotely spaced, the second ends 28 also adjacent surface 12 but being more closely spaced so as to make the opening defined by surface 12 wider between pour guard first ends 26 and narrower between pour guards second ends 28. Curved pieces 10 are attached adjacent inner edge portions 24, extending upwardly therefrom. Importantly, the ends of curved pieces 10 extend beyond pour guard first and second ends 26 and 28 respectively, but do not extend beyond the outermost portion of surface 12. By extending beyond the ends of the pour guards 22, the curved pieces 10 form an effective channelling spout for pouring the contents from a can on which the protector spout device is attached. Because curved pieces 10 do not extend beyond the outermost portions of surface 12, they do not create a protrusion to be knocked or bumped whereby the paint can could be tipped and the contents spilled.

Thus, there has been shown the perferred embodiment of a groove protector and spout device which fulfills all of the objects and advantages sought therefor. Many changes, modifications, variation, and other uses in application of the present construction will, however, become apparent to those skilled in the art after considering this specification and accompanying drawings. All such changes, modification, variations, and other uses and applications which do not depart from the spirit and scope of the invention are deemed to be covered by the invention limited only by the claims which follow.

What is claimed is:

1. A groove protector and spout device for attaching to the upper portion of a paint can consisting of:

a planar ring member having parallel top and bottom surfaces and defining a substantially circular opening, frictional attachment means extending downwardly from said planar ring member including an outside wall portion located adjacent to the outside periphery of said ring planar member and an inside wall portion located adjacent the inside periphery of said planar ring member, said outside wall portion and said inside wall portion being parallel and extending downwardly an equal amount, said inside wall portion, said outside wall portion and said bottom surface defining a space for receiving the upper portion of a paint can, said outside wall portion and said inside wall portion being slidably engageable with said outside periphery and said inside periphery respectively of the upper portion of a paint can to frictionally attach said device thereto, said bottom surface being adjacent the upper portion of the paint can when so attached, an annular ridge member having a substantially semicircular cross section located on said bottom surface and extending downwardly therefrom, said ridge member being intermediately positioned between said inside wall member and said outside wall member and being engageable with both the inside and outside edges of the groove of a paint can to prevent the penetration of paint into the groove from either edge when said device is frictionally attached to said paint can, a pair of opposed pour guards coplanarly joined to said inside periphery of said planar ring member and extending into said circular opening, said opposed pour guards each having a convex inside edge, an inner end and an outer end opposite said inner end, said inner ends being in opposed relation and in close proximity with each other, said outer ends being relatively far apart, and, a pair of raised lip portions each joined to the top surface of said ring member and to one of said opposed pour guards adjacent said convex inside edge, said raised lip portions each projecting upwardly and extending from the outer periphery of said ring member adjacent said inner end of one of said opposed pour guards to the outer periphery of said ring member adjacent said outer end of said pour guard to form a pouring spout which does not extend beyond the outer periphery of said ring member.

* * * * *